US005893417A

United States Patent [19]

Pizzolato

[11] Patent Number: 5,893,417

[45] Date of Patent: Apr. 13, 1999

[54] WIRELINE LUBRICATION WIPER

[76] Inventor: Charles W. Pizzolato, 36 Texas Ave., Houma, La. 70360

[21] Appl. No.: 08/853,107

[22] Filed: May 8, 1997

[51] Int. Cl.[6] ..... E21B 19/08; E21B 37/10

[52] U.S. Cl. ..... 166/377; 166/77.1; 166/85.3; 166/84.1; 166/379; 166/382; 166/385; 166/387

[58] Field of Search ..... 166/70, 77.1, 84.2, 166/84.1, 85.1, 85.3, 177.3, 377, 379, 382, 385, 387

[56] References Cited

U.S. PATENT DOCUMENTS

| | | | |
|---|---|---|---|
| 1,369,913 | 3/1921 | Brunhoff . | |
| 2,998,071 | 8/1961 | Bohn | 166/77.1 |
| 3,216,731 | 11/1965 | Dollison | 166/84.1 X |
| 3,500,907 | 3/1970 | Gentry | 166/70 |
| 3,556,209 | 1/1971 | Reistle, III et al. | 166/70 |
| 3,568,767 | 3/1971 | Weiss . | |
| 3,637,009 | 1/1972 | James | 166/77.1 X |
| 3,924,686 | 12/1975 | Arnold . | |
| 4,037,660 | 7/1977 | Newsom et al. | 166/302 |
| 4,489,780 | 12/1984 | Duhon | 166/70 |
| 4,577,693 | 3/1986 | Graser | 166/77.1 X |
| 4,658,894 | 4/1987 | Craig | 166/84 |
| 4,665,976 | 5/1987 | Retherford | 166/81 |
| 4,716,962 | 1/1988 | Rundell | 166/84 |
| 5,088,559 | 2/1992 | Taliaferro | 166/379 |
| 5,392,861 | 2/1995 | Champagne | 166/379 |

OTHER PUBLICATIONS

Eastern Oil Tools; General Products Catalog; pp. 30 and 47 (undated).

*Primary Examiner*—George Suchfield
*Attorney, Agent, or Firm*—David L. Ray

[57] ABSTRACT

A method and apparatus for preventing leakage and spillage of oil from a wireline lubricator when the lubricator is disconnected from an oil and/or gas well including a generally cylindrical hollow coupling assembly adapted for connection to the bottom of the wireline lubricator, and a swab for contacting and forming a seal with the exterior of the tool in the wireline lubricator to prevent leakage of oil from the wireline lubricator.

11 Claims, 4 Drawing Sheets

WIRELINE LUBRICATION WIPER

BACKGROUND OF THE INVENTION

1. Field of the Invention

The invention relates to wellhead lubricators. In particular, the invention relates to wellhead lubricators connected to the top of a wellhead or "Christmas Tree."

2. Description of the Related Art

"Wellhead lubricators" and "wireline lubricators" are well known in the art. "Wellhead lubricators" and "wireline lubricators" are devices which are connected to the top of a wellhead of an oil and/or gas well, or to a Christmas Tree connected to an oil and/or gas well to receive a cylindrical wireline tool which is suspended from a wire and lowered into the well to perform such tasks as logging, perforation, and the like. The lubricators are used to seal the volume of the pipe in which the wireline and tool is inserted to counteract the pressure in the petroleum and/or gas well and prevent gas and/or oil from escaping around the wireline during wireline operations.

When a wireline lubricator is removed from a Christmas Tree, there is a leakage of oil from the lubricator onto the area around the Christmas Tree. The leakage of lubricant from the lubricator can cause damage to the environment. Furthermore, it is expensive and time consuming to remove the spilled lubricant from the area upon which it has leaked.

Exemplary of the patents of the related art are the following U.S. Patents: U.S. Pat. Nos. 1,369,913; 3,500,907; 3,556,209; 3,568,767; 3,924,686; 4,489,780; 4,658,894; 4,665,976; 4,716,962; 5,088,559; and 5,392,861.

SUMMARY OF THE INVENTION

In accordance with the present invention there is provided a method and apparatus for preventing leakage and spillage of oil from a wellhead or wireline lubricator when the lubricator is disconnected from a Christmas Tree. The apparatus for preventing leakage of lubricant from the wireline lubricator includes a generally hollow cylindrical coupling assembly for connection to the bottom of the lubricator after removing the lubricator from the Christmas Tree, and a swab for contacting and forming a seal with the exterior of the tool inserted in the wireline lubricator to prevent leakage of oil from the lubricator. The coupling assembly may also contain a conduit for conveying oil from the interior of the assembly to a point remote from the assembly, such as a reservoir or barrel.

The present invention has the advantage of preventing leakage and spillage of oil from a wellhead or wireline lubricator.

The present invention has the advantage of being low in cost.

The present invention has the additional advantage of being easily and quickly connected to the bottom of a lubricator after disconnection of the lubricator from the top of a Christmas Tree.

The present invention has the further advantage of being low in weight and easily handled by an individual workman.

DESCRIPTION OF THE PREFERRED EMBODIMENTS

Figure 1:
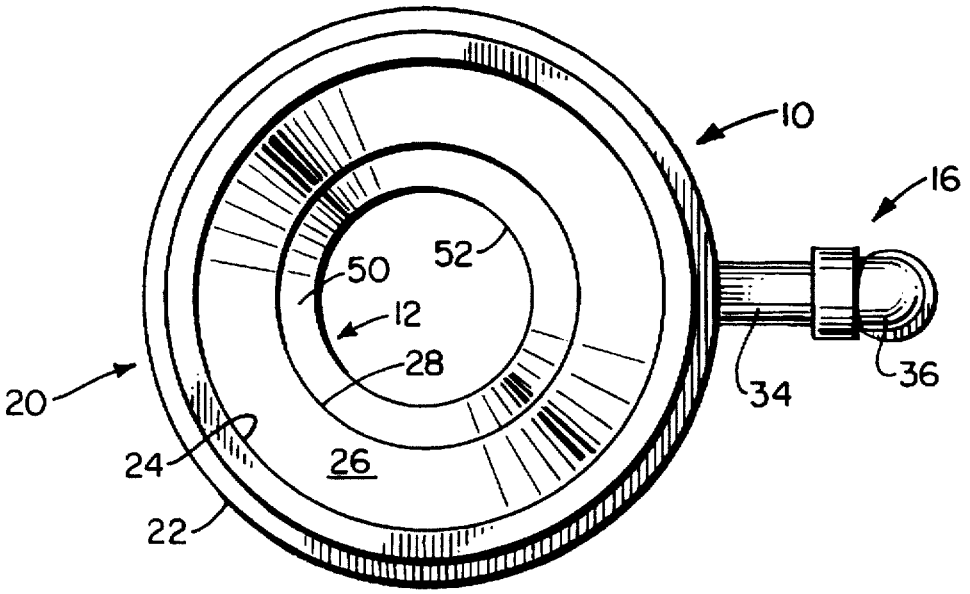
FIG. 1 is a top plan view of the coupling assembly of the present invention.
Figure 2:
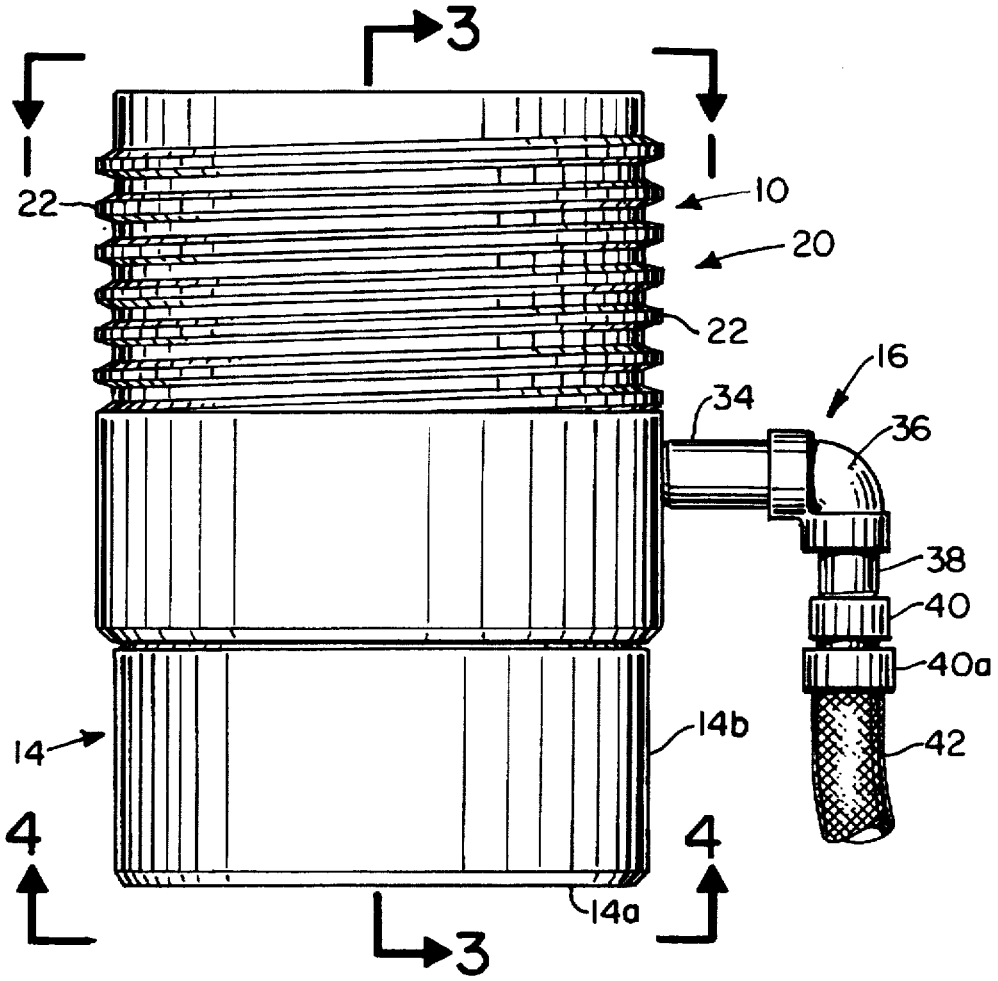
FIG. 2 is a side elevational view of the coupling assembly of the present invention.

Referring now to the drawings, in FIGS. 1 through 4 are shown the preferred coupling assembly of the invention generally indicated by the numeral 20. Coupling assembly 20 includes a threaded, hollow generally cylindrical coupling generally indicated by the numeral 10, a swab generally indicated by the numeral 12, a cap generally indicated by the numeral 14, and a conduit assembly generally indicated by the numeral 16.

Coupling 10 is generally cylindrical in shape and has male threads 22 on the upper, outside portion thereof. Threads 22 are used for threadably connecting coupling 10 to the wireline lubricator generally indicated by the numeral 25 in FIGS. 5, 6, and 7. Wireline lubricator 25 has an internally threaded female coupling 25*a* located on the lower end thereof as shown in FIG. 7 which receives male threads 22.

Figure 3:
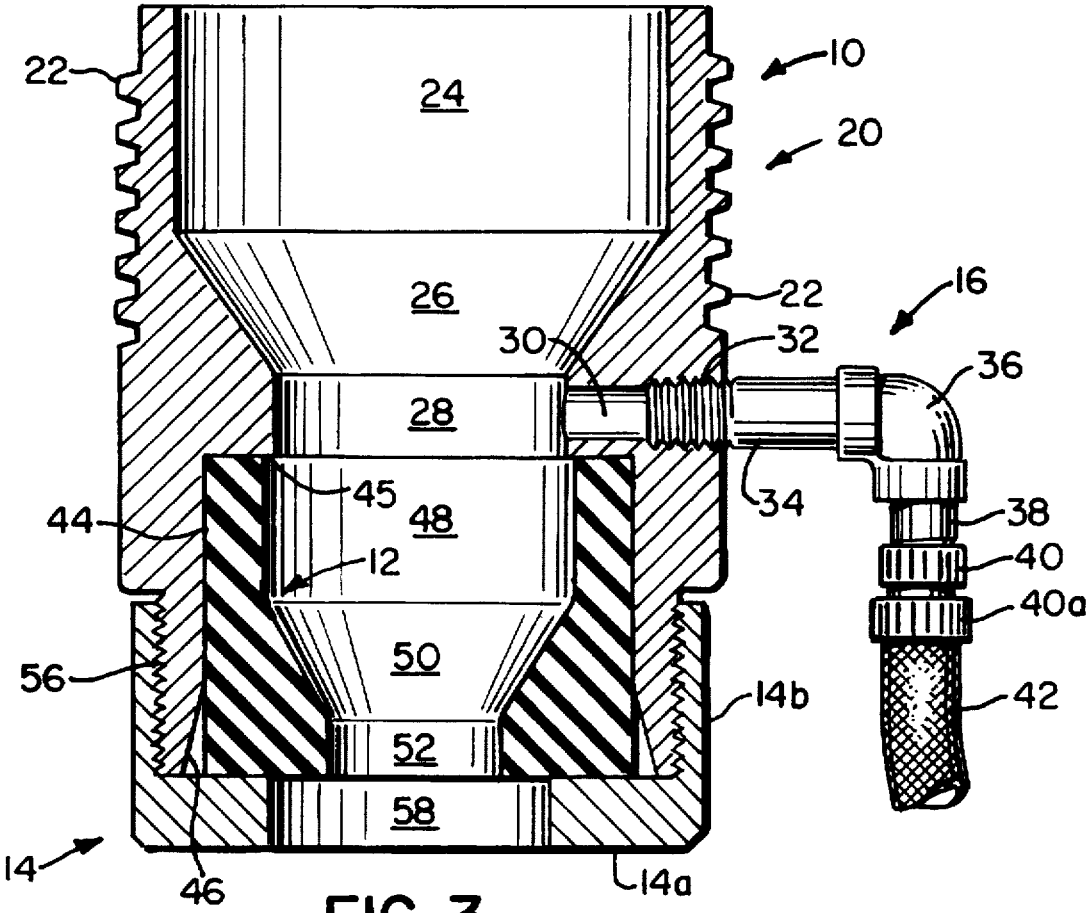
FIG. 3 is a cross sectional view taken along Lines 3—3 of FIG. 2.
Figure 4:
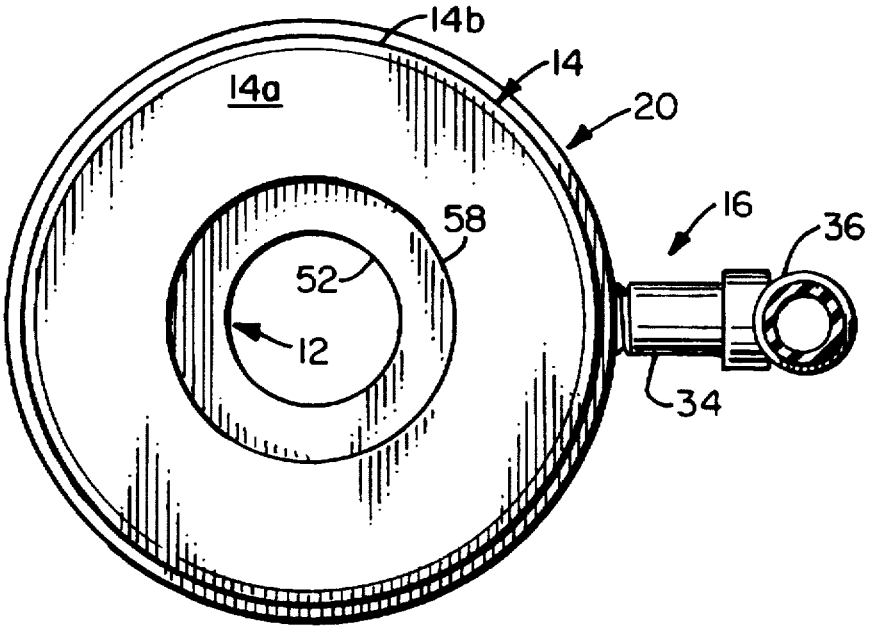
FIG. 4 is a bottom view taken along Lines 4—4 of FIG. 2.

As shown in FIG. 3, coupling 10 has a cylindrical inside bore 24 which is axially aligned with the inside bore 25*b* of lubricator 25 when male threads 22 are received in the internal female threads of coupling 25*a*.

Coupling 20 preferably has a top tapered bore 26 located adjacent to bore 24 and located immediately therebeneath which is axially aligned with bore 24. Located adjacent to and immediately beneath tapered bore 26 is cylindrical bore 28, which is axially aligned with bore 24 and bore 26. Bore 28 is smaller in diameter than the lower portion of tapered bore 26. Tapered bore 26 is tapered to smoothly guide a tool such as tool 54 into bore 28.

Bore 28 preferably has a hollow cylindrical cavity 30 extending horizontally therefrom perpendicular to the longitudinal axis of bore 28. Cylindrical cavity 30 communicates has female threads 32 on the outer end thereof which are machined in axial alignment with cavity 30 to receive the male threads on threaded pipe 34. Threaded pipe 34 has a conventional hollow elbow 36 threaded thereto, and a pipe 38 is threadably connected to the bottom end of elbow 36. A conventional hose coupling 40 is threadably connected to the lower end of pipe 38, and hose 42 is connected to hose coupling 40 by rotatable coupling 40*a*.

Oil contained in and above bore 28 can flow outward from coupling 10 through cylindrical cavity 30, through pipe 34, through elbow 36, through pipe 38, through hose couplings 38 and 40, into hose 42. Hose 42 is preferably extended to a reservoir such as a barrel for storing and transporting oil draining from tool 25 into coupling assembly 20.

Located immediately beneath and adjacent to bore 28 is bore 44, which is cylindrical in shape and receives swab 12.

Bore 44 is larger in diameter than bore 28. The intersection of bore 44 and bore 28 defines circular shoulder 45. Located adjacent to and immediately beneath bore 44 is outwardly tapered bore 46. Bore 46 is tapered outwardly to enable swab 12 to be easily inserted therein.

As shown in FIG. 3, swab 12 has a generally cylindrical exterior which is preferably sufficiently large in diameter to be snugly fitted into bore 44. Swab 12 has a hollow cylindrical cavity 48 therein adjacent to the top end thereof. Located adjacent to and immediately beneath cylindrical cavity 48 is an inwardly tapered cavity 50. Located adjacent to and immediately beneath tapered cavity 50 is a reduced diameter cylindrical cavity 52 which is preferably slightly smaller in diameter than the outside diameter of the tool 54 shown in FIG. 6 and FIG. 7.

Tool 54 may be any wireline tool well known in the art. Tool 54 is suspended by wireline 55 shown in prior art FIG. 5 which extends over pulley 55*a*. When lubricator 25 is connected to Christmas tree 23, tool 54 may be lowered by wireline 55 into and through Christmas tree 23 and downward into well 23*a*. Tool 54 may be withdrawn into lubricator 25 as shown in FIGS. 6 and 7, and lubricator 25 may then be disconnected from Christmas tree 23.

As is known in the art, wireline tools such as tool 54 are generally cylindrical in shape. As can be seen in FIG. 7, the lower, smaller diameter bore 52 of swab 12 forms a sliding seal with the outside surface of tool 54, thereby preventing lubricant stored above bore 52 from escaping around the outside surface of tool 54.

Located at the bottom end of swab 12 is cap 14 which is connected by female threads 56 thereon to the male threads on the lower end of coupling 10. Cap 14 holds swab 12 in place inside of bore 44 beneath shoulder 45 of coupling 10 and prevents leakage of oil around the outside of swab 12 between swab 12 and bore 44. Cap 14 has a cylindrical bore 58 in the lower end thereof for receipt of tool 54. Bore 58 is axially aligned with bores 52, 50, 48, 28, 26 and 24. Bore 58 has a circular, horizontal shoulder 14*a* extending completely therearound. Wall 14*b* is integrally formed with horizontal shoulder 14*a* and extends vertically upward therefrom.

Swab 12 is constructed from a flexible, elastic material such as natural or synthetic rubber, or a flexible, elastic polymeric material, or the like. Cylindrical cavity 52 in swab 12 has a diameter which is slightly smaller than the diameter of tool 54 which is received therein. Thus, the tool 54 is force fitted into cavity 52, and cavity 52 forms a seal with the outside surface of tool 54 which prevents oil in lubricator 25 from leaking between the outside of tool 54 and cavity 52. When tool 54 is inserted into cavity 52, the outside of swab 12 adjacent to cavity 52 can expand into tapered bore 46.

Figure 7:
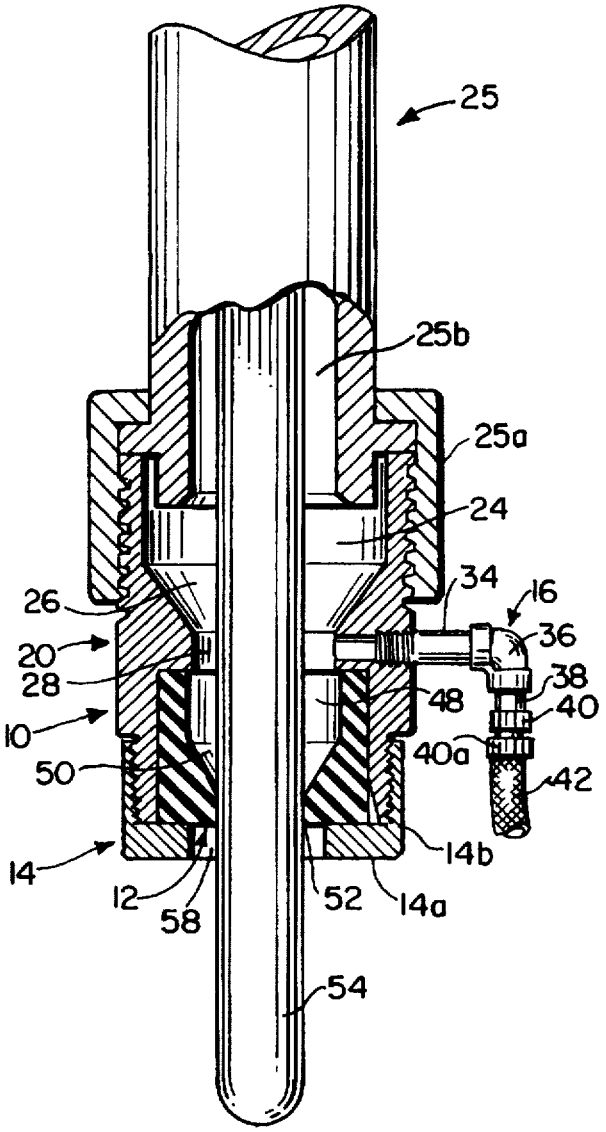
FIG. 7 is a cutaway cross sectional view of the assembly of the present invention connected to a prior art lubricator with the tool of the lubricator extending through the assembly to achieve a seal.
Figure 8:
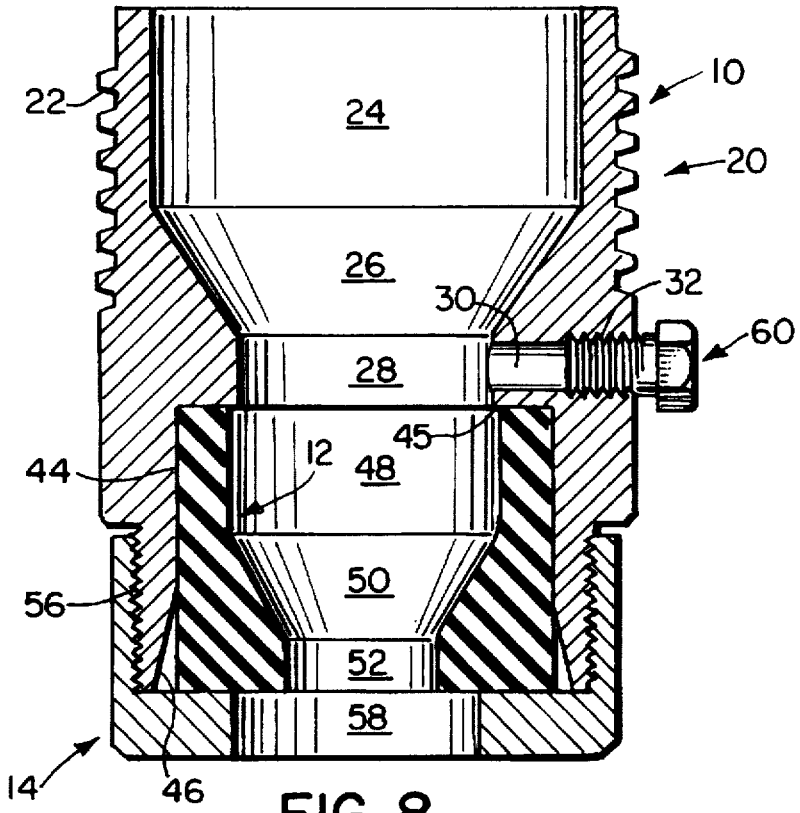
FIG. 8 is a cross sectional view taken along Lines 3—3 of FIG. 2 showing a plug threaded onto the coupling assembly of the invention.

An alternate arrangement of the coupling assembly 20 is shown in FIG. 8 wherein conduit assembly 16 is omitted and replaced with a threaded plug generally indicated by the numeral 60. Threaded plug 60 has male threads thereon which are received in female threads 32. Plug 60 prevents oil from flowing outward from cylindrical cavity 30 when it is not desired to utilize conduit assembly 16 and hose 42 to convey oil to a reservoir. When plug 60 is used as shown in FIG. 8, the coupling assembly 20 is attached to the lubricator 25 after the tool 54 is withdrawn to the position shown in FIGS. 6 and 7. The lubricator 25 can then be moved to a position over a reservoir such as a barrel, and coupling assembly 20 can be removed from lubricator 25. The oil in lubricator 25 can then drain into the reservoir, thereby preventing pollution of the area around the Christmas tree.

Figure 9:
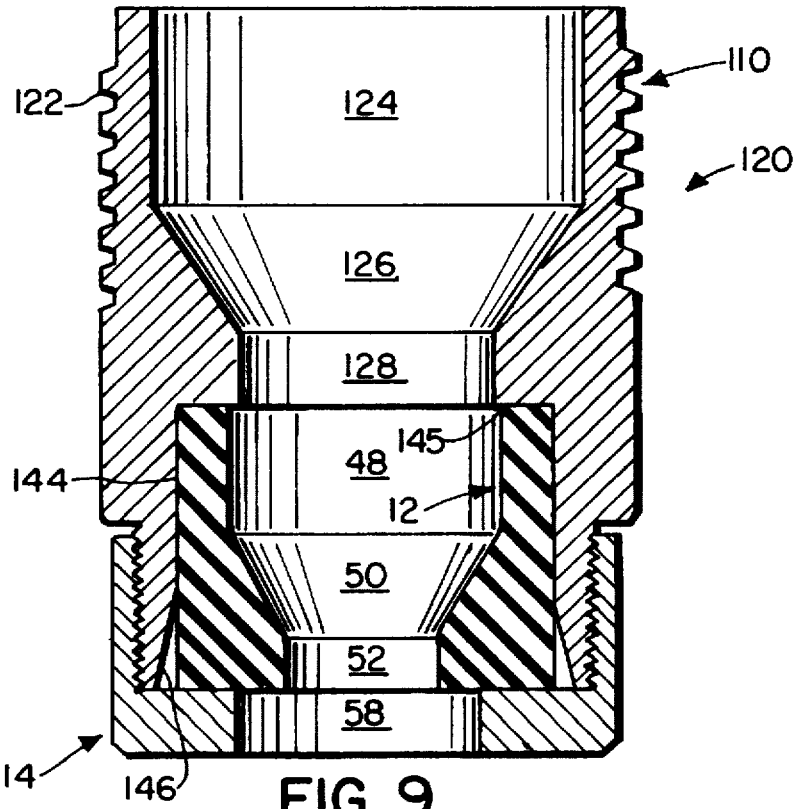
FIG. 9 is a cross-sectional view of an alternate embodiment of the invention.

An alternate embodiment of the coupling assembly of the invention is shown in FIG. 9 and is generally indicated by the numeral 120. Coupling assembly 120 is similar to coupling assembly 20, except that coupling assembly 120 does not have the conduit assembly 16 and cavity 30 of coupling assembly 20. Coupling assembly 120 is used in the same manner described above for coupling assembly 20 shown in FIG. 8 when plug 60 is connected thereto.

Coupling assembly 120 includes a threaded, hollow generally cylindrical coupling generally indicated by the numeral 110, swab 12 described above, and cap 14 described above.

Figure 5:
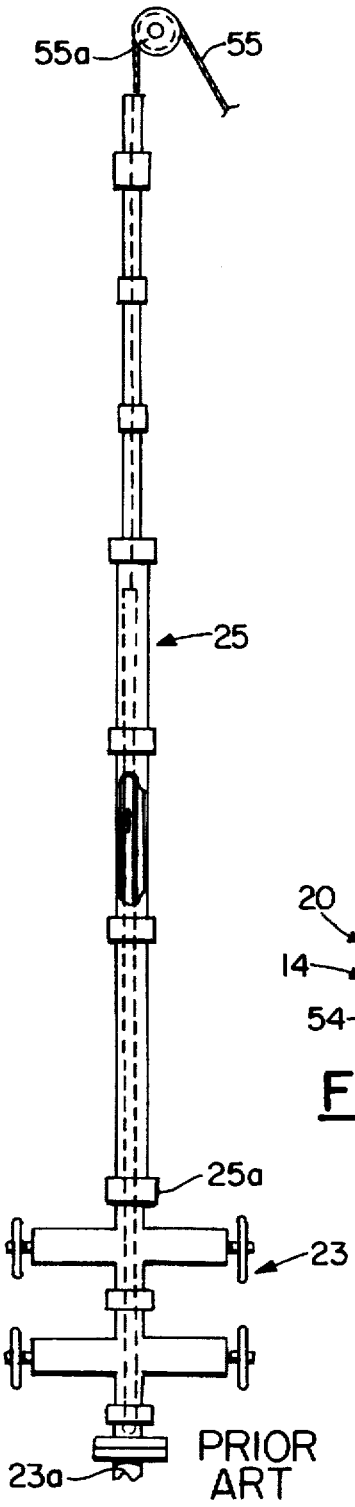
FIG. 5 is a prior art wellhead or wireline lubricator connected to a Christmas Tree.
Figure 6:
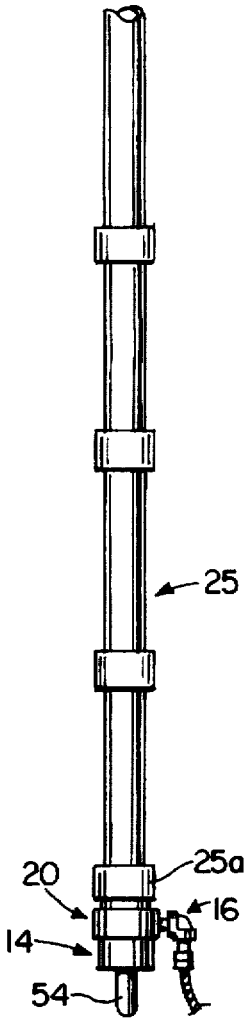
FIG. 6 is the coupling assembly of the present invention connected to the wellhead or wireline lubricator of FIG. 5 after disconnection of the lubricator from the Christmas Tree shown in FIG. 5.

Coupling 110 is generally cylindrical in shape and has male threads 122 on the upper, outside portion thereof Threads 122 are used for threadably connecting coupling 110 to the wireline lubricator 25 shown in FIGS. 5, 6, and 7 and previously described.

As shown in FIG. 9, coupling 110 has a cylindrical inside bore 124 which is axially aligned with the inside bore 25*b* shown in FIG. 7 of lubricator 25 when male threads 122 are received in the internal female threads of coupling 25*a* which is rigidly connect to the bottom of lubricator 25.

Coupling 110 has a tapered bore 126 located adjacent to bore 124 and located immediately therebeneath which is axially aligned with bore 124. Located adjacent to and immediately beneath tapered bore 126 is cylindrical bore 128, which is axially aligned with bore 124 and bore 126.

Located immediately beneath and adjacent to bore 128 is circular shoulder 145 and bore 144, which is cylindrical in shape and receives swab 12. Located adjacent to and immediately beneath bore 144 is outwardly tapered bore 146. Swab 12 is held inside bore 144 and shoulder 145 by cap 14.

Couplings 10 and 110, and cap 14, are preferably made from aluminum alloys to minimize the weight of the coupling assemblies of the invention. However, rigid metal materials such as steel alloys that are commonly used in the petroleum industry in manufacture pipe, tools, and the like, may be used to construct couplings 10 and 110, and cap 14, if desired. Couplings 10 and 110 can also be varied in size as desired to fit tools of various sizes.

The size and number of bores 24, 26, and 28 in coupling 10, the bores 124, 126, and 128 in coupling 110, and the bores 48, 50, and 52 in swab 12 can be varied as desired to fit different sized tools 54. The bore 58 in cap 14 may also be varied in size as desired to fit different sized tools 54.

The method for using the coupling assemblies 20 and 120 of the invention includes withdrawing tool 54 from well 23*a* into bottom of lubricator 25 a distance sufficient for the inside surface of cavity 52 of swab 12 to contact the outside surface of tool 54, disconnecting lubricator 25 from Christmas tree 23, and threading the male threads of coupling assemblies 20 or 120 into the female threads of coupling 25*a* of lubricator 25 to fit tool 54 in swab 12 and form a seal therebetween. The coupling assemblies 20 or 120 preferably are immediately connected to the coupling 25*a* of lubricator 25 after disconnection of lubricator 25 from Christmas Tree 23 to minimize leakage of oil from lubricator 25 after disconnection from Christmas Tree 23.

The coupling assemblies of the invention may also be used to prevent leakage from lubricator 25 while changing or repairing tool 54. After disconnection of the lubricator from Christmas tree 23 and connection of coupling assembly 20 or 120 thereto, the tool may be extended downward from swab 12 a distance sufficient to permit repair or replacement of the tool 54, while still maintaining an oil seal at the upper end of tool 54 with bore 52 of swab 12 or with a conventional tool holder (not shown) known to those skilled in the art which are commonly used to connect tools such as tool 54 to wireline 55.

Although the preferred embodiments of the invention have been described in detail above, it should be understood that the invention is in no sense limited thereby, and its scope is to be determined by that of the following claims:

What is claimed is:

1. An apparatus for preventing leakage and spillage of oil from a wireline lubricator when the lubricator is disconnected from an oil and/or gas well, said wireline lubricator having a cylindrical tool therein suspended on a wireline for lowering into said well, said apparatus comprising a generally cylindrical hollow coupling assembly adapted for connection to the bottom of said wireline lubricator, said coupling assembly having a swab therein for contacting and forming a seal with the exterior of said tool in said wireline lubricator to prevent leakage of oil from said wireline lubricator, said coupling assembly comprising a hollow coupling adapted for connection to the bottom of said wireline lubricator, and a hollow cap adapted for connection to the bottom of said coupling, wherein said cap is generally cylindrical in shape and has a bore in the bottom thereof having a shoulder therearound for receipt of said tool, said bore being smaller in diameter than the outside diameter of said cap.

2. The apparatus of claim 1 wherein said swab is located inside said coupling and is larger in outside diameter than said diameter of said bore.

3. The apparatus of claim 1 wherein said swab located is located inside said coupling and said cap.

4. The apparatus of claim 1 wherein said swab is generally cylindrical in shape and hollow inside.

5. The apparatus of claim 1 wherein said swab is elastic.

6. The apparatus of claim 5 wherein said swab is constructed from a polymeric material.

7. The apparatus of claim 4 wherein the hollow inside of said swab is adapted to contact and form a seal with the exterior of said tool in said wireline lubricator to prevent leakage of oil from the interior of said wireline lubricator around the outside of said tool and the inside of said swab.

8. The apparatus of claim 1 wherein said coupling assembly has a cap connected thereto to hold said swab inside said coupling.

9. The apparatus of claim 8 wherein said cap has a bore therein for receipt of said tool.

10. The apparatus of claim 9 wherein said coupling assembly has a conduit connected thereto for conveying oil from the interior of said coupling assembly to the exterior of said coupling assembly.

11. The apparatus of claim 10 wherein said coupling assembly has a cavity therein for receiving said conduit and conveying oil in the interior of said coupling assembly to said conduit.

* * * * *